US007524123B1

(12) United States Patent
Coté

(10) Patent No.: US 7,524,123 B1
(45) Date of Patent: Apr. 28, 2009

(54) SCENTED MECHANICAL WRITING IMPLEMENT

(76) Inventor: Christopher W. E. Coté, 6160 Fairmount Ave., Suite 1, San Diego, CA (US) 92120

( * ) Notice: Subject to any disclaimer, the term of this patent is extended or adjusted under 35 U.S.C. 154(b) by 0 days.

(21) Appl. No.: 11/957,708

(22) Filed: Dec. 17, 2007

(51) Int. Cl.
*B43K 29/00* (2006.01)

(52) U.S. Cl. ..... 401/195; 401/99

(58) Field of Classification Search ..... 401/195, 401/209, 52, 49, 99; 428/905
See application file for complete search history.

(56) References Cited

U.S. PATENT DOCUMENTS 3,660,055 A * 5/1972 Haller ..... 44/535
3,888,416 A * 6/1975 Lin ..... 239/34
5,233,371 A * 8/1993 Guillet ..... 351/111
6,190,078 B1 * 2/2001 Smith ..... 401/195
6,217,242 B1 4/2001 Cote
6,273,626 B1 * 8/2001 Yazawa ..... 401/6
6,899,486 B2 * 5/2005 Wetzel et al. ..... 401/195

* cited by examiner

*Primary Examiner*—David J Walczak
(74) *Attorney, Agent, or Firm*—Seed IP Law Group PLLC

(57) ABSTRACT

A fragrant mechanical writing implement comprises a rigid, hollow, elongated barrel of absorbent material to which a writing implement mechanism for extending and retracting from one end thereof a writing tip. The absorbent material is impregnated with a fragrance by soaking in a liquid fragrance.

8 Claims, 3 Drawing Sheets

SCENTED MECHANICAL WRITING IMPLEMENT

TECHNICAL FIELD

The present invention relates to mechanical writing implements such as ballpoint pens and mechanical pencils, and in particular a mechanical writing implement impregnated with a scent, fragrance or aroma.

BACKGROUND

The present applicant has invented a fragrant pencil and a method of making same which is the subject of U.S. Pat. No. 6,217,242 entitled "Scented Writing Implement". Pencils are typically constructed of a wood casing surrounding a graphite core. The wood casing is partially removed at one end to expose some of the core, such as graphite, for the purpose of writing, drawing or marking. The present inventor's previously patented fragrant pencil comprised a solid elongated body of absorbent material surrounding a core of marking material, wherein the absorbent material was impregnated with a fragrance and upon sharpening of the pencil a portion of the solid body was removable to expose a portion of the core of marking material and to expose a portion of the body of absorbent material to the atmosphere, thereby releasing the fragrance. Such fragrant pencil was manufactured by a) providing a pencil made from an absorbent material; b) submerging the pencil in a bath of liquid fragrance for a period of time sufficient for such pencil to absorb the fragrance; and c) removing the pencil from the bath and allowing it to dry.

While the invention which is the subject of U.S. Pat. No. 6,217,242 provides a fragrant pencil, such is not suitable for other common types of writing implements which use mechanical means for advancing and retracting the writing tip. These include ballpoint pens and mechanical pencils. There is therefore a need for a mechanical writing implement which is provided with a fragrance. It is therefore an object of the present invention to provide a mechanical writing implement such as a ballpoint pen or mechanical pencil with an impregnated scent, aroma or fragrance.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The invention provides a mechanical writing implement comprising a rigid, hollow, elongated body of absorbent material forming an elongated hollow interior chamber open at both ends thereof, and accommodating therein a writing implement mechanism for extending and retracting from one end thereof a writing tip, wherein the absorbent material is impregnated with a fragrance. The invention further provides a method of manufacturing a mechanical writing implement comprising:

a) providing a rigid, hollow elongated body of absorbent material forming an elongated hollow interior chamber open at both ends thereof;

b) submerging the rigid, hollow elongated body of absorbent material in a bath of liquid fragrance for a period of time sufficient for such rigid, hollow elongated body to absorb the fragrance;

c) removing the rigid, hollow elongated body from the bath and allowing it to dry; and d) securing to a first end of the rigid, hollow elongated body of absorbent material a mechanism for the retraction and extension from said second end of a writing tip.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
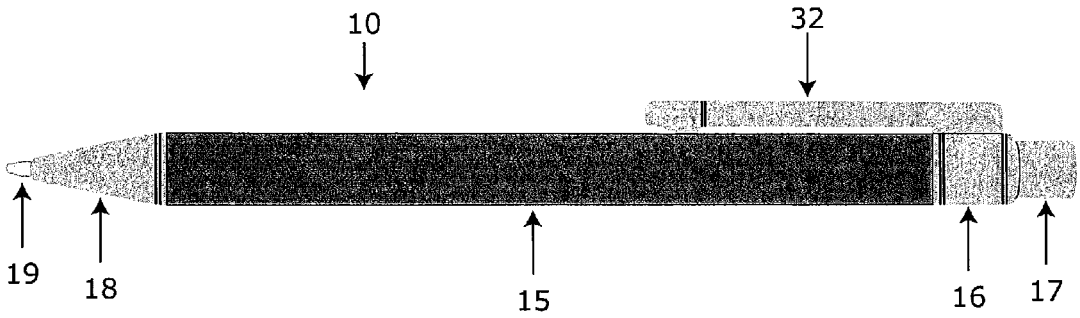
FIG. 1 is an elevation view of a writing implement in accordance with the present invention.
Figure 2:
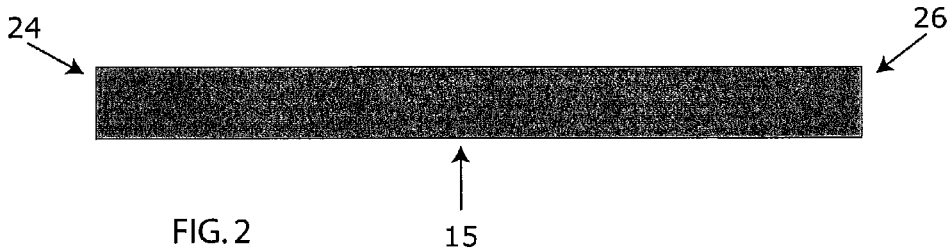
FIG. 2 is an elevation view of a barrel for the implement shown in FIG. 1.
Figure 3:
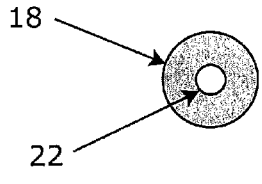
FIG. 3 is a left side view of the nose piece shown in FIG. 4.

With reference to FIG. 1, a ballpoint pen or mechanical pencil 10 comprises a hollow cylindrical barrel 15 constructed preferably of pressed recycled cardboard. The length and diameter of hollow cylindrical barrel 15 are selected in accordance with typical sizes of ballpoint pens and mechanical pencils, such as 3 inches to 6 inches in length and ¼ inch to inch in diameter. The thickness of the pressed cardboard is selected to give rigidity to the implement, typically 1/16 inch to ⅛ inch.

Secured to one end of barrel 15 is conical nose piece 18. Nose piece 18 is co-axially secured to the barrel 15 by gluing to the end 24 of barrel 15 or press-fitting a circular rim 21 (FIG. 4), which has roughly the same diameter as the inner diameter of barrel 15, into the hollow end 24 of barrel 15. Nose piece 18 has a circular aperture 22 through which the tip 19 of the mechanical writing implement retractably extends. Similarly secured to the opposite end 26 of barrel 15 is the mechanism 28/30 for the retractable ball point pen or mechanical pencil. Pocket clip base 16 and attached pocket clip 32 are attached to connector 20 which is co-axially secured to the barrel 15 by gluing or press-fitting into the end 26 of barrel 15. Connector 20 has a hollow cylindrical core through which the upper plunger 17 and lower plungers 42/58 move axially.

Figure 4:
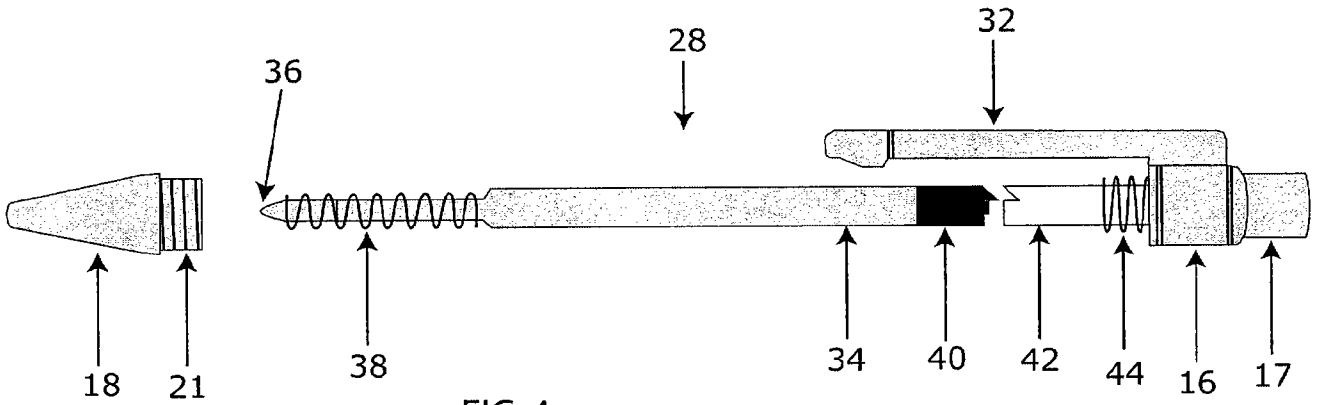
FIG. 4 is an exploded elevation view of a ballpoint pen in accordance with the present invention.
Figure 5:
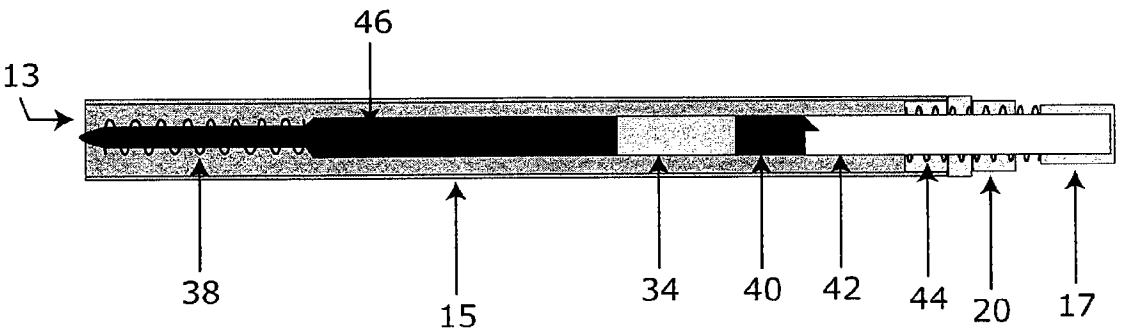
FIG. 5 is a partial cross sectional view of the ballpoint pen shown in FIG. 4 with the nose piece removed.

FIGS. 4 and 5 illustrate the embodiment of the invention which provides a ballpoint pen. Ballpoint pen mechanism 28 includes a replaceable ink cartridge 34 containing liquid ink 46. Cartridge 34 has ballpoint writing tip 36, spring 38 which bears against the interior of nose piece 18 and end cap 40 which engages the end of lower plunger 42, connected to upper plunger 17. A spring 44 can also be provided to increase the biasing force of retraction when upper plunger 17 is depressed. The ink cartridge 34, springs 38 and 44 and lower plunger 42 are all contained within the hollow interior chamber 13 of barrel 15.

Figure 6:
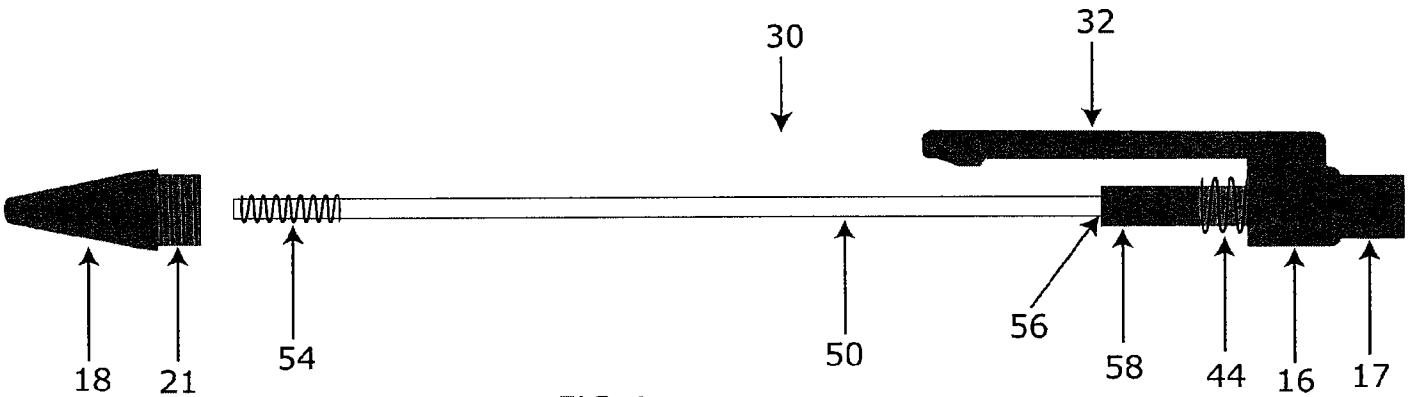
FIG. 6 is an elevation view of a mechanical pencil assembly for use in accordance with the present invention.
Figure 7:
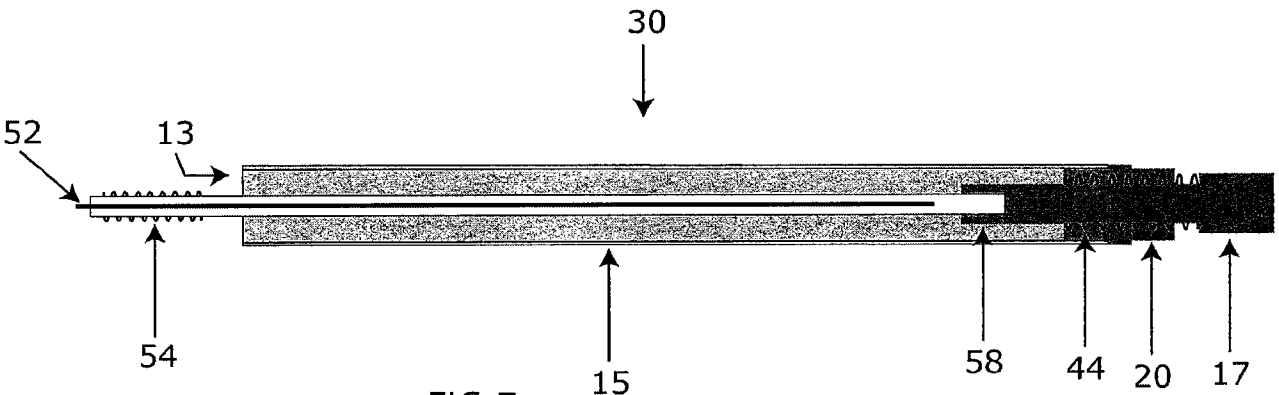
FIG. 7 is a cross sectional view of a mechanical pencil in accordance with the present invention with the nose piece removed.

FIGS. 6 and 7 illustrate the embodiment of the invention which provides a mechanical pencil. Mechanical pencil mechanism 30 includes a lead cartridge 50 which has replaceable lead 52, spring 54 which bears against the interior of nose piece 18 and end 56 which engages the end of lower plunger 58, connected to upper plunger 17. The lead cartridge 50, spring 54 and lower plunger 58 are all contained within the hollow interior chamber 13 of barrel 15.

In order to provide a fragrance to the mechanical writing implement, as further described below, barrel 15 is impregnated with an aroma, scent or fragrance. Barrel 15 is preferably a rigid cylinder of generally polygonal or circular cross-sectional shape forming a hollow cylindrical central chamber 13 running axially along the length of the barrel 15 for accommodating the writing implement mechanism 28/30.

Barrel 15 is preferably compressed recycled cardboard which is absorbent for impregnating with fragrance. The barrel 15 is submerged into a bath of liquid fragrance such as strawberry, coffee, honey-nut, etc. and allowed to soak for approximately 30 minutes. The liquid fragrances are existing fragrances manufactured by fragrance manufacturers and are non-toxic chemical formulations that are either water, alcohol or glycol soluble. Due to the absorbency of barrel 15, it absorbs the liquid fragrance through its interior and exterior surfaces. It is then allowed to dry for up to approximately 30 minutes, and the writing implement mechanism 28/30 attached to it as described above.

After the barrel 15 has dried, an adhesive label may be attached to it, or a trademark or logo printed on it. Preferably however an area of barrel 15 is left uncoated with a scratchable surface whereby upon scratching a portion thereof, an area of the absorbent material is exposed to the atmosphere to thereby release fragrance. Thus, while the barrel 15 will always emit some fragrance, when the surface of the barrel 15 is scratched with a fingernail, the edge of a ruler or other sharp edge, an increased amount of fragrance will be emitted from the absorbent barrel. In this way the user of the writing implement can reinvigorate the amount of fragrance emitted.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A mechanical writing implement comprising a rigid, hollow elongated body of absorbent material forming an elongated hollow interior chamber open at both ends thereof, and accommodating therein a writing implement mechanism for extending and retracting a writing tip, wherein said absorbent material is impregnated with a fragrance and, wherein said absorbent material comprises compressed cardboard.

2. The mechanical writing implement of claim 1 wherein said rigid, hollow, elongated body of absorbent material has a scratchable surface whereby upon scratching a portion thereof, an area of said absorbent material is exposed to the atmosphere to thereby release fragrance.

3. The mechanical writing implement of claim 1 wherein said fragrance is a liquid-soluble fragrance.

4. The mechanical writing implement of claim 1 wherein said fragrance is water, alcohol or glycol soluble.

5. A method of manufacturing a mechanical writing implement comprising:

a) providing a rigid, hollow elongated body of absorbent material forming an elongated hollow interior chamber open at both ends thereof, wherein said absorbent material comprises compressed cardboard;

b) submerging said rigid, hollow elongated body of absorbent material in a bath of liquid fragrance for a period of time sufficient for such rigid, hollow elongated body to absorb said fragrance;

c) removing said rigid, hollow elongated body from said bath and allowing it to dry; and d) securing to a first end of said rigid, hollow elongated body of absorbent material a mechanism for the retraction and extension from said second end of a writing tip.

6. The method of claim 5 wherein a portion of the surface of said rigid, hollow, elongated body of absorbent material is scratchable, whereby upon scratching a portion thereof, an area of said absorbent material is exposed to the atmosphere to thereby release fragrance.

7. The method of claim 5 wherein said fragrance is a liquid-soluble fragrance.

8. The method of claim 5 wherein said fragrance is water, alcohol or glycol soluble.

* * * * *